United States Patent [19]

Nischwitz

[11] 4,258,879

[45] Mar. 31, 1981

[54] ROOM HEATING DEVICE

[76] Inventor: Edmond P. Nischwitz, 2110 Iowa St., Peoria, Ill. 61604

[21] Appl. No.: 9,782

[22] Filed: Feb. 6, 1979

[51] Int. Cl.[3] ..... F24B 1/18

[52] U.S. Cl. ..... 237/51; 126/164; 126/121; 126/132; 122/128

[58] Field of Search ..... 126/121, 164, 132, 165, 126/101; 122/371, 128; 110/298; 237/51

[56] References Cited

U.S. PATENT DOCUMENTS

| | | | |
|---|---|---|---|
| 213,138 | 3/1879 | Shepard | 126/101 |
| 1,505,627 | 8/1924 | Bellescize | 126/120 |
| 3,244,164 | 4/1966 | Cooper | 126/132 |
| 4,049,196 | 9/1977 | Bergami, Jr. et al. | 237/51 |
| 4,062,345 | 12/1977 | Whiteley | 237/51 |
| 4,078,542 | 3/1978 | Young et al. | 126/164 |
| 4,091,794 | 5/1978 | Stites | 126/121 |
| 4,149,517 | 4/1979 | Horwinski | 126/121 |

*Primary Examiner*—Albert J. Makay
*Assistant Examiner*—Henry Bennett
*Attorney, Agent, or Firm*—Charles E. Lanchantin, Jr.

[57] ABSTRACT

A room heating device (10) includes a hollow grate (30) for heating water contained therein and for heating air communicating therethrough in response to a fire. The hollow grate (30) has a plurality of interconnected ducts (40–45) and a conduit (50) passing through the ducts (40–45) defining a water and steam containing chamber (48) externally of the conduit (50) and a passage (54) internally of the conduit (50). A fan (92) forces air to be heated through the passage (54) and outwardly to a room. The grate (30) finds particular utility in a fireplace (12) for supporting a plurality of logs (97).

19 Claims, 5 Drawing Figures

ROOM HEATING DEVICE

DESCRIPTION

1. Technical Field

The present invention relates to a room heating device, and more particularly to a device responsive to the heat of a fire for controllably directing supplemental heated air to a room using hot water and steam for more effective heat transfer.

2. Background Art

It has long been known that about 65% of the available heat of the burning wood in a conventional fireplace goes up the chimney. Thus, for the most part, the fireplace remains a relatively uneconomical means of heating a home.

One way to improve the overall efficiency of a fireplace is to utilize a plurality of C-shaped metal tubes welded together to form a grate for supporting a plurality of logs in the fireplace. Room air enters each of the open tubes at the bottom, is heated and is forced out the top into the room by natural heat convection, although blowers can be added to circulate room air more rapidly through the tubes by way of an intermediate distribution manifold. Such a fireplace grate is available, for example, from Thermograte Enterprises, Inc., of 51 Iona Lane, St. Paul, Minn.

A considerable number of other fireplace devices are known which operate on the principle of forcing air by use of a blower through various tubular members disposed around the floor or walls of the fireplace and into the room to be heated. Unfortunately, the fire impinges directly upon the ferrous metal tubes of these prior art devices so as to cause premature deterioration thereof by tube burn-out. Deterioration is even more rapid if coal, charcoal or other high heat energy fuel is burned in the fire. Moreover, such devices have not been as efficient as desired or have been excessively costly in construction.

In order to more effectively use the energy of the fuel in the fireplace, other devices have been proposed to circulate water through tubular members disposed around the periphery of the fireplace or made into a grate for holding the logs. The heated water is thereafter directed to a radiator, a hot water tank or the like to supplement the heating capacity of the usual heating system of the building. These devices, however, have also not been as effective as desired in supplying supplemental hot air to a room.

The present invention is directed to overcoming one or more of the problems as set forth above.

DISCLOSURE OF INVENTION

In accordance with one aspect of the invention, a room heating device is provided having a hollow frame for heating water contained therein and for heating air communicating therethrough in response to a fire. The hollow frame includes a plurality of interconnected ducts and a conduit passing through the ducts to define a water chamber external of the conduit and an air passage internally thereof for supplying supplemental heated air to a room.

In another aspect of the invention a hollow frame of the aforementioned type is provided for use as a log supporting grate in a fireplace, and a blower is connected to the conduit to force the air to be heated through the internal passage thereof.

Advantageously, because of such construction the ducts can be made of a ferrous metal and the conduit made of a high heat conducting metal such as copper, because the water and steam located therebetween maintains relatively lower and more uniform temperatures thereof. Moreover, the flames of the fire do not act directly upon the copper conduit so that a long service life thereof is effected.

BEST MODE FOR CARRYING OUT THE INVENTION

Figure 1:
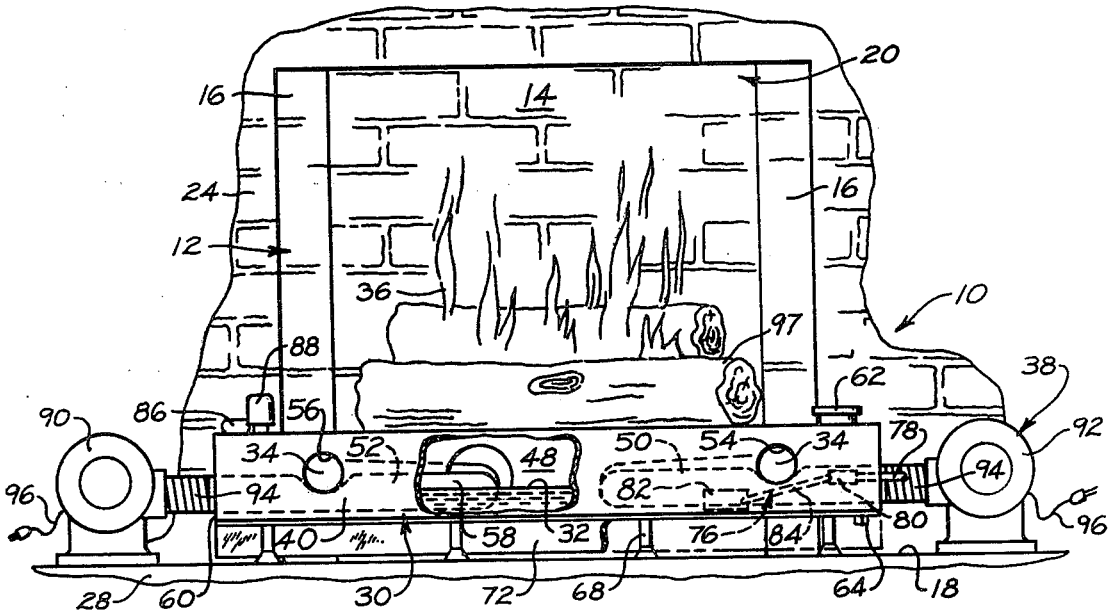
FIG. 1 is a diagrammatic front elevational view of a fireplace including the room heating device of the present invention, with a portion broken open to better illustrate details thereof.
Figure 2:
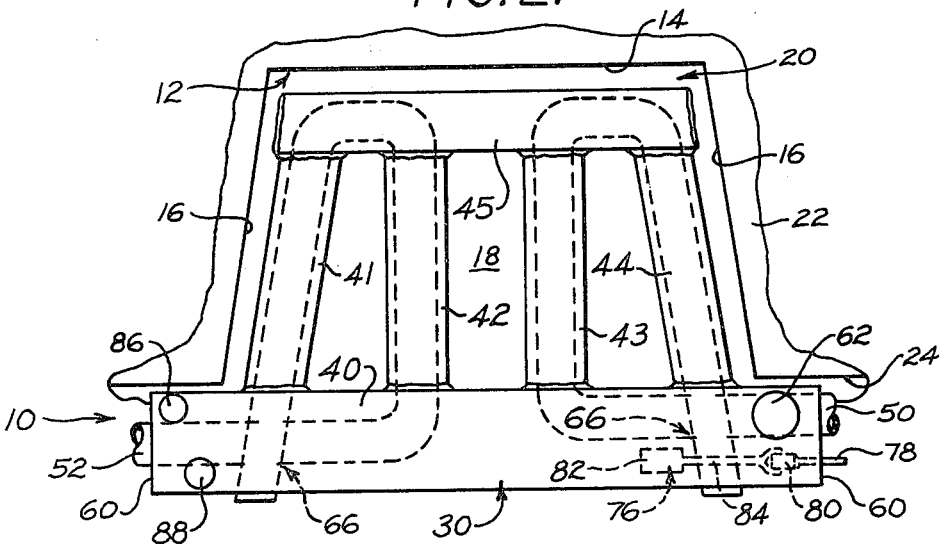
FIG. 2 is a diagrammatic top plan view of the room heating device shown in FIG. 1, with the fan means and fire itself deleted for illustrative convenience.
Figure 3:
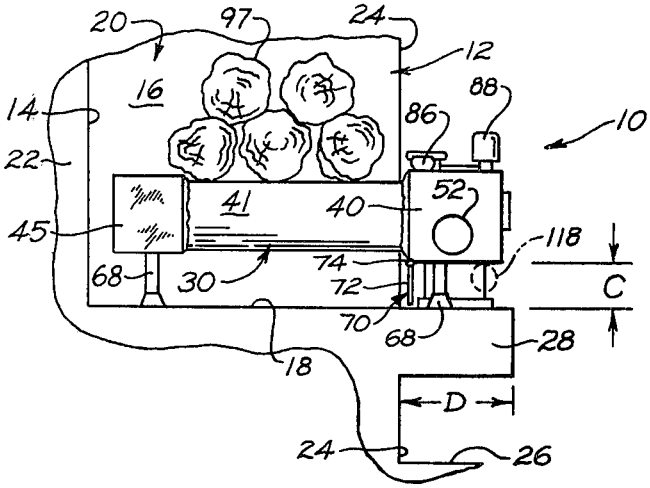
FIG. 3 is a diagrammatic side elevational view of the room heating device shown in FIGS. 1 and 2.

Referring initially to FIGS. 1 to 3 of the drawings, a room heating device 10 is shown for providing supplemental heat to a room external of a fireplace 12. The fireplace has a backwall 14, a pair of forwardly or outwardly diverging sidewalls 16, and a floor or hearth 18 generally defining a fireplace opening 20. The fireplace is thus generally recessed in a wall 22 having an external surface or front face 24. As shown best in FIG. 3, the hearth is elevated above a floor surface 26 and provides a sill 28 extending outwardly a preselected distance D from the front face 24.

Referring to FIG. 1, the room heating device 10 advantageously includes hollow frame or grate means 30 for heating water 32 contained therein and for heating air 34 communicating therethrough in response to exposure to the heat of a fire 36. Fan means 38 are provided for controllably forcing air therethrough and outwardly into the room, and helping to condense steam back to water within the hollow frame and to maintain a preselected steam pressure operating range with the hollow frame.

Basically, in the instant embodiment, the hollow frame means 30 includes a plurality of interconnected ferrous metal ducts 40–45 defining a water and steam containing chamber 48, and a pair of conduits 50, 52 passing through the chamber and defining a pair of internal passages or second and third open chambers 54, 56 for heating the air that is blown therethrough. Preferably, each of the conduits 50, 52 is a cylindrical copper tube having an external surface 58 which is exposed to the hot water and steam contained within the substantially closed main chamber 48. With this construction the ducts 40–45 can be conveniently welded together in an interconnecting grid-like pattern, and the box-sectioned front duct 40 provided with opposite end walls 60, a water fill pipe and releasable cap 62, and a water drain plug 64. The rear duct 45 has a box cross section slightly smaller than the front duct, and the remaining ducts 41–44 are cylindrical and extend between the front and rear ducts. The copper conduits 50, 52 are easily bent to conform to the internal shape of the ducts and, in the instant example, are each formed into a single loop having a crossover joint 66 where the conduits are flattened slightly for space-saving purposes. Moreover, the conduits extend through and are preferably sealingly welded or brazed to the end walls and the front portion of the front duct 40.

The front duct 40 is advantageously arranged along the sill 28 of the fireplace hearth 18, and the ducts 40–45 are supported on the hearth by a plurality of adjustable pedestals or support legs 68 as best shown in FIG. 3. A preselected clearance C is thus provided elevationally above the hearth and below the ducts for the induced rearward flow of air from the room and upwardly through the openings defined by the intersecting ducts to keep the fire burning. The support legs 68 are adjustable or extensible to maintain the hollow frame means 30 in a horizontal attitude and to provide the desired water level within the chamber 48.

Preferably, an adjustable draft mechanism 70 is connected to the bottom of the front duct 40 to better control the rearward flow rate of air under the hollow frame means 30 and to limit forward movement of hot ashes into the room. This mechanism includes an elongate damping flap 72 that can be rotated about a longitudinally extending pivot joint 74. For example, by manually rotating the flap 72 in a clockwise direction from the position illustrated in FIG. 3 and securing it at the newly selected position, the amount of air entering under the fire can be increased to control the intensity of the fire as desired.

While the room heating device 10 requires only a minimum amount of water for replenishment purposes, for example a half gallon per day, it is contemplated that automatic water replenishing means 76 can be provided as best shown at the bottom right portions of FIGS. 1 and 2. A conduit 78 connected to the usual building pressurized water supply extends into the hollow frame means 30 and is in communication with a shut-off valve 80, and a float 82 is connected to the valve through a pivotally elevatable linkage 84. When the level drops the float pivots the linkage in a counterclockwise direction when viewing FIG. 1 to open the valve 80 and allow additional make-up water to be automatically supplied to the main chamber 48.

The front duct 40 is provided with a combination vcuum relief valve and a maximum pressure relief valve 86 at the top part thereof, and preferably is also provided with a regulator or humidifier valve 88. For example, steam pressure in excess of about 30 psig in the main chamber 48 can be relieved to the room through the relief valve 86, which is preferably of the automatic reseating popaction type, and a limited quantity of steam can be controllably supplied to the room through the regulator valve 88 when the steam pressure is above about 10 psig in the main chamber to beneficially increase the humidity in the room. It is contemplated that these valves can be so located as to relieve steam directly into one of the ducts 50, 52 and to humidify the air being heated before it is blown into the room by the fan means 38. In effect, such relief valves serve to operate the heating device 10 as a steam boiler which also humidifies the room.

The fan means 38 includes an opposite pair of squirrel cage blowers or centrifugal fans 90, 92 connected to the front duct 40 by flexible conduits 94. For example, each fan can be a 60 cubic feet per minute flow rate squirrel cage fan, operating at 2,750 rpm and having about 1/45 HP, and identified as the Dayton Model 40443 fan produced by the Electric Manufacturing Co. of Chicago, Ill. The fans are connected to a source of electricity through the usual connecting lines 96, and are preferably turned on automatically through a thermostatic switch or steam pressure switch, not shown, associated with the ducts 40–45. For example, when the temperature of the steam in the chamber 48 reaches about 240° F. or the pressure reaches about 10 psig, the fans 90, 92 can be automatically started by closure of the switch to circulate air individually through the opposite conduits 50, 52.

INDUSTRIAL APPLICABILITY

In operation, a plurality of logs 97 are placed centrally on top of the grate means 30, and thereafter a fire is started in the usual manner in the fireplace 12. The temperature of the water and air in the main chamber 48 rises as the ducts 40–45 heat as a result of the fire, and at a preselected steam temperature the fans 90, 92 turn on automatically. Air at room temperature is then forced into each of the conduits 50, 52 and temperature measurements adjacent the outlets thereof soon indicate that 140° F. air is being supplied to the room. Typically, this takes between 15 and 30 minutes after starting the fire. Moreover, the humidifier valve 88 soon emits a low hissing noise indicating the controlled release of moisture and/or steam into the room preferably via the conduits 50, 52. The water 32 is maintained at an elevation at least part way up on the conduits, and not fully submerging the conduits, to better transmit heat thereto and to allow a portion of the steam to condense back to water at the top thereof due to the cooler air passing through the passages 54, 56.

Figure 4:
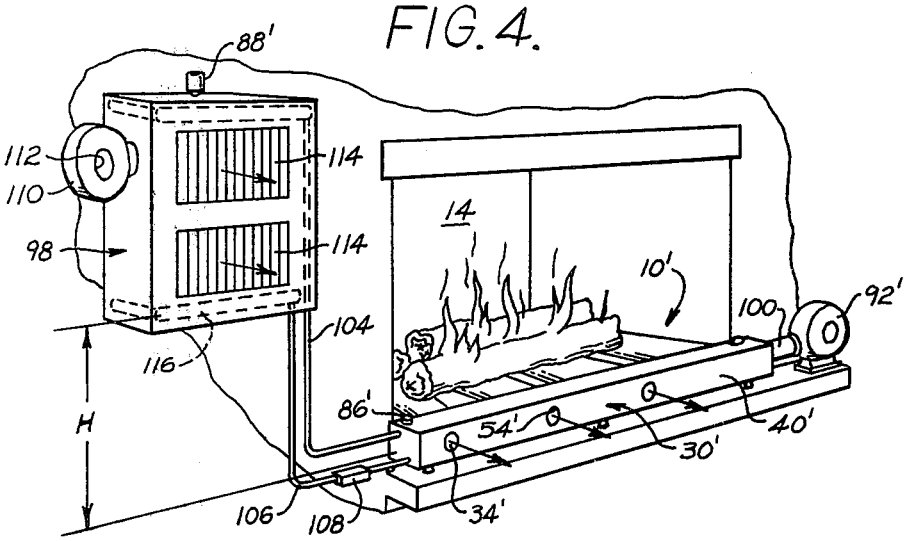
FIG. 4 is a diagrammatic perspective view of a fireplace including a second embodiment room heating device constructed in accordance with the present invention and including radiator means spaced away from the fireplace.
Figure 5:
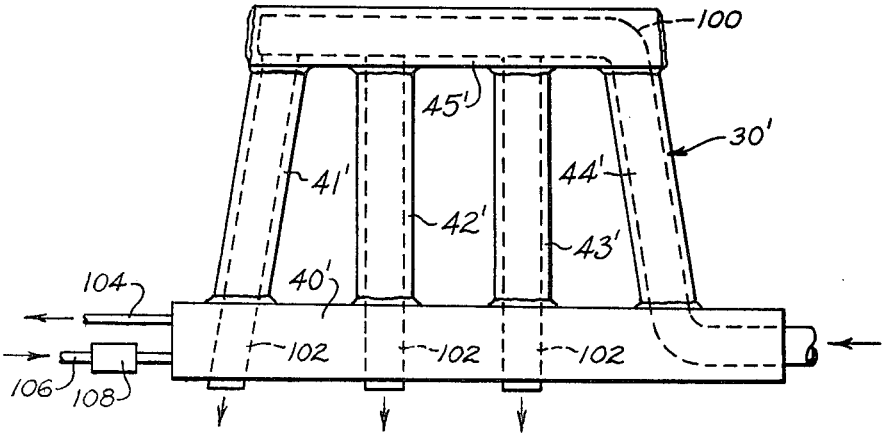
FIG. 5 is a diagrammatic and fragmentary top plan view of the room heating device of FIG. 4.

Referring now to FIGS. 4 and 5, a second embodiment heating device 10' is shown which differs from the heating device 10 by the construction of the grate means 30' including a blower fan 92' and the addition of supplemental radiator means 98. Elements similar to those described above with respect to the first embodiment are designated by similar reference numerals with prime indicators.

More particularly, the grate means 30' preferably includes an air inlet manifold 100 connected to the blower fan 92' and a plurality of branch outlet conduits 102. With this construction the inlet manifold is located adjacent the backwall 14 of the fireplace and the branch outlet conduits extend from the manifold toward the front.

Referring now to the radiator means 98, such means is connected to the front duct 40' through a steam outlet or riser line 104 and a condensate return line 106 having a condensate trap 108 therein. The radiator means preferably is a finned tube heat exchanger or convector forming with the source of steam in the main chamber 48' and the lines 104, 106 a two-pipe supplemental steam heating system. A thermostatically or pressure controlled, electrically operated squirrel cage blower 110 similar to the fans 90, 92 previously described, is preferably connected to the radiator means 98 for withdrawing substantially ambient air from the room at an air inlet port 112, blowing it past the heat exchanger tubes, not shown, and blowing it out into the room through the air outlet ports 114. A water collecting chamber or tank 116 at the bottom of the radiator means is preferably disposed at a preselected elevation above the front duct 40' so that the water level in the collecting tank 116 is a preselected height H above the water level in the front duct as is diagrammatically indicated in FIG. 4. For example, a preselected height H of more than two feet is preferred for effective gravity return of water through the condensate trap 108 at the advantageous low pressure of the steam heating system, i.e., less than a range of about 15 to 30 psig.

Thus, in operation, the radiator means 98 receives the steam from the grate means 30', heats the air forced therethrough by the fan 110 and directs the air outwardly into the room at a location spaced away from the heated air passing outwardly from within the branch conduits 102, and elevatably above the conduits. Moreover, the steam is condensed in the radiator means, collected in the tank 116, and returned by gravity and pressure through the trap 108 back to the grate means.

I have started fires at a faster rate by uncoupling the right blower fan 92 and associated flexible conduit 94 of the room heating device 10 of FIG. 1 from the duct 40, and turning the fan on by a manual electrical switch, not shown. Then I have used this source of blown air to create a more rapid draft under the fire to accelerate the heat output of the fire and the rate of temperature and pressure build-up within the main chamber 48 of the grate means 30. I contemplate that a forced air draft tube 118 can be connected to the bottom of the front duct 40 as indicated in phantom lines in the right portion of FIG. 3. Then the flexible conduit 94 can be temporarily connected to the draft tube in order to blow air through a plurality of rearwardly directed ports in the tube, not shown, for such faster fire starting. After the fire is going along well the flexible conduit 94 can be reconnected to the conduit 50 through a slip joint or the like.

It can, therefore, be appreciated that the subject room heating devices 10, 10' are most desirably used in a fireplace for providing not only supplemental hot air to a room, but also supplemental moisture to the room via the common and substantially closed chamber 48 and the humidifier valve 88. The chamber contains both hot water and steam in use, and the pressure thereof is desirably limited to less than about 30 psig by the relief valve 86 to define a relatively low pressure steam heating system. The low pressure steam in the chamber not only acts directly upon the copper conduit to transfer heat thereto, but is also available for a multitude of other uses, for example, the remote radiator means 98 and for operating other appliances requiring steam.

Advantageously, the fire does not impinge directly upon the air-containing conduits 50, 52, 100, 102 and the water and steam in the chamber 48 serves to maintain the temperature of the ducts and conduits at a relatively low value for maintaining a long service life.

Other aspects, objects and advantages of this invention can be obtained from a study of the drawings, the disclosure and the appended claims.

What is claimed is:

1. A room heating device (10) for placement in a fireplace (12), comprising:

a front duct (40);

a rear duct (45);

a plurality of ducts (41–44) interconnecting said front duct (40) and said read duct (45), said ducts (40–45) being arranged in a substantially horizontal manner;

conduit means (50,52/100,102) for defining a chamber (48) within said ducts (40–45) and externally of said conduit means (50,52/100,102) and for defining internal passage means (54,56) internally of said conduit means (50,52/100,102), said chamber (48) containing hot water and steam in response to a fire (36) in the fireplace (12); and fan means (38) for forcing air to be heated through said internal passage means (54,56) and outwardly of the fireplace (12).

2. The room heating device (10) of claim 1 including radiator means (98,104,106,108) for receiving steam from said chamber (48), heating air at a location spaced away from the fireplace (12), and returning water to said chamber (48).

3. The room heating device (10) of claim 1 wherein said conduit means (50,52/100,102) includes first and second conduits (50,52), each of said conduits (50,52) being formed into a loop.

4. The room heating device (10) of claim 1 wherein the fireplace (12) has a hearth (18) and a front face (24), and including means (68) for supporting said front duct (40) in spaced relationship above said hearth (18) and outwardly of said front face (24).

5. The room heating device (10) of claim 1 including valve means (88) for supplying supplemental moisture and steam to the room for increasing the humidity thereof, said valve means (88) being in communication with the steam in said chamber (48) at said front duct (40).

6. The room heating device (10) of claim 1 including leg means (68) for supporting said ducts (40–45) elevationally above the floor (18) of the fireplace (12) and adjustably maintaining a horizontal attitude of said ducts (40–45).

7. The room heating device (10) of claim 1 wherein said conduit means (50,52/100,102) includes first and second conduits (50,52) individually having an external surface (58) exposed to water and steam in said chamber (48) and not exposed directly to said fire (36).

8. The room heating device (10) of claim 1 wherein said conduit means (50,52/100,102) includes first and second conduits (50,52) individually passing into said front duct (40), through a portion of said plurality of ducts (41–44) and said rear duct (45), and out said front duct (40).

9. The room heating device (10) of claim 1 wherein said conduit means (50,52/100,102) includes an inlet manifold (100) and a plurality of branch outlet conduits (102) connected to said inlet manifold (100) and extending forwardly through said front duct (40).

10. The room heating device (10) of claim 8 wherein said front duct (40) has opposite end walls (60) and said conduits (50,52) extend individually through a respective one of said end walls (60), and said fan means (38) includes a fan (90,92) connected to each one of said conduits (50,52).

11. A room heating device (10) for placement in a fireplace (12), comprising:

a front duct (40);

a rear duct (45);

four ducts (41–44) connecting said front and rear ducts (40,45), said ducts (40–45) being arranged on a substantially common horizontal plane; and a pair of conduits (50,52) individually defining an internal passage (54,56), each conduit (50,52) passing into and through a separate portion of said ducts (40–45) and out said front duct (40), and defining a common chamber (48) within said ducts (40–45) and externally of said conduits (50,52), said chamber (48) containing hot water and steam in response to a fire in the fireplace (12), said internal passages communicating hot air to the room.

12. The room heating device (10) of claim 11 wherein the fireplace has a floor (18) and including means (68) for supporting said ducts (40–45) above the floor (18) in a horizontal position, said ducts (40–45) being of a construction sufficient for supporting fuel such as logs (97) thereon.

13. The room heating device (10) of claim 12 including an elongate damping flap (72) connected to the bottom of the front duct (40) and being of adjustable construction sufficient for regulating the draft of air elevationally intermediate the floor (18) and the front duct (40).

14. The room heating device (10) of claim 31 including fan means (38) for forcing air to be heated through said conduits (50,52).

15. A room heating device (10) for placement in a fireplace (12), comprising:

a front duct (40');

a rear duct (45');

four ducts (41'–44') connecting said front and rear ducts (45',45'), said ducts (40'–45') being collectively arranged on a substantially common horizontal plane;

an inlet manifold conduit (100) passing through said front duct (40'), one of said four ducts (41'–44') and said rear duct (45'); and three conduits (102) connected to said inlet manifold conduit (100) and passing forwardly through three of said four ducts (41'–44') and out through said front duct (40'), said conduits (100,102) defining a common chamber (48) within said ducts (40'–45') and externally of said conduits (100,102) sufficient for containing hot water and steam in response to a fire (36) in the fireplace (12), said conduits defining a plurality of air passages communicating hot air to the room.

16. The room heating device (10) of claim 15 including a plurality of adjustable legs (68) supporting said ducts (40'–45') in a horizontal position, said ducts (40'–45') being of a construction sufficient for supporting fuel such as logs (97) thereon.

17. The room heating device (10) of claim 15 including fan means (38) for forcing air to be heated into said inlet manifold conduit (100).

18. A room heating device (10) for placement in a fireplace (12), comprising:

a plurality of interconnected ducts (40–45) arranged on a substantially common horizontal plane;

a conduit (50/100,102) having an external surface (58) and an internal air passage (54), said conduit (50/100,102) passing through a portion of said ducts (40–45), said conduit (50/100,102) and said ducts (40–45) defining an internal chamber (48) within said ducts (40–45) and externally of said conduit (50/100,102);

fan means (38) for forcing air to be heated through the air passage (54) of the conduit (50/100,102) and outwardly of the fireplace (12), said external surface (58) of the conduit (50/100,102) being exposed to hot water and steam in said chamber (48) in response to a fire (36) in the fireplace (12) and not exposed directly to said fire (36).

19. The room heating device (10) of claim 18 including means (76) for maintaining a preselected water level in said internal chamber (48).

* * * * *